US008087268B1

(12) United States Patent
Pruitt

(10) Patent No.: US 8,087,268 B1
(45) Date of Patent: Jan. 3, 2012

(54) THREAD RETAINED SECURITY BOLT SYSTEM

(75) Inventor: Alva Glen Pruitt, Lebanon, MO (US)

(73) Assignee: The Durham Company, PMD, Lebanon, MO (US)

( * ) Notice: Subject to any disclaimer, the term of this patent is extended or adjusted under 35 U.S.C. 154(b) by 484 days.

(21) Appl. No.: 12/407,138

(22) Filed: Mar. 19, 2009

(51) Int. Cl.
*E05B 73/00* (2006.01)

(52) U.S. Cl. ..... 70/14; 70/56; 70/140; 70/164; 70/232; 70/DIG. 57

(58) Field of Classification Search ..... 70/14, 54–56, 70/58, 140, 164, 175–180, 229–232, DIG. 57
See application file for complete search history.

(56) References Cited

U.S. PATENT DOCUMENTS

| | | | | |
|---|---|---|---|---|
| 1,856,091 | A | 5/1932 | Dina | |
| 2,733,589 | A * | 2/1956 | Mutty | 70/58 |
| 3,089,330 | A | 5/1963 | Kerr | |
| 3,665,739 | A * | 5/1972 | Boll | 70/237 |
| 3,784,727 | A * | 1/1974 | Haubein | 70/DIG. 57 |
| 3,876,242 | A * | 4/1975 | Eaton | 280/511 |
| 4,365,108 | A * | 12/1982 | Bright | 174/50 |
| 4,577,884 | A * | 3/1986 | Harris | 70/237 |
| 6,062,583 | A * | 5/2000 | Lauricella, Jr. | 280/507 |
| 6,106,035 | A | 8/2000 | Hetherington | |
| 6,428,061 | B1 * | 8/2002 | Daoud | 292/251 |
| 6,453,707 | B2 * | 9/2002 | Nishimura et al. | 70/180 |
| 7,562,546 | B2 * | 7/2009 | Taylor | 70/56 |
| 2009/0158791 | A1 * | 6/2009 | Hudman et al. | 70/232 |

* cited by examiner

*Primary Examiner* — Lloyd Gall
*Assistant Examiner* — David E Sosnowski
(74) *Attorney, Agent, or Firm* — Richard L. Marsh

(57) ABSTRACT

A thread retained security bolt system has a bottom collar and a top collar, the bottom collar fixed to one element of an enclosure and the top collar affixed to a mating element of the enclosure. The top collar carries a minor part of a securing bolt bearing surface and the bottom collar carries a major part of the securing bolt bearing surface and when the mating element of the enclosure is brought into engagement with the one element of the enclosure, the minor part is aligned with and contiguous to the major part upon joinder of the top collar with the bottom collar. A bearing surface of a head of a bolt is then moved into engagement with the minor part and the major part to secure the one element to the mating element.

20 Claims, 5 Drawing Sheets

THREAD RETAINED SECURITY BOLT SYSTEM

BACKGROUND OF THE INVENTION

1. Field of the Invention

This invention relates to a security bolt system for cabinets.

2. Prior Art Statement

It is known to provide a lock having a closure member comprising a stationary stud having a threaded end, a sleeve surrounding the threaded end of the stud, a complementary member having an internal thread adapted to engage the stud and an external tapered surface adapted to engage the sleeve, the complementary member carried by one element of the enclosure and the stationary stud and sleeve carried by another element of the enclosure, the members adapted to maintain the elements in fixed relative position. For instance, see the U.S. Pat. No. 1,856,091 issued on 3 May 1932, to Augusto Dina. As with most closure locks using a bolt to capture one element against the other, the end of the bolt must be inserted into a threaded interior, the threads engaged and the bolt tightened thereinto. Often times, the end of the bolt is damaged from attempts to insert same into the threaded interior despite the fact that the end of the bolt is provided with a taper. With the mating tapered surfaces, the lock system of Dina is very expensive to manufacture. There is a need for a lock having a closure member that presents the bearing surfaces to a position behind a bolt head wherein the bolt is already retained in a threaded receiver where the mating parts may be extruded from metal or plastic material.

It is also known to provide a lock assembly for a refrigerated cabinet has a spring loaded bolt carried by the door and a fixed nut in the cabinet wherein the bolt is inserted into the nut, the threads engaged and the bolt tightened into the nut to effect closure of the refrigerated cabinet. Later refrigerated cabinets have a split nut that parts when the bolt is inserted into the split nut. For instance, see the U.S. Pat. No. 3,089,330 issued on 7 Dec. 1961 to William J. Kerr. Damage to the end of the bolt still exists as the threads are jammed into initial engagement with the nut. Thus, there is a need for threaded security bolt system wherein the threads of the bolt are always in engagement with the nut and the closure parts are positioned behind the head of the bolt upon closure of a door against the cabinet.

It is further known to provide an overhang on a movable closure member that substantially conceals a closure bolt and a locking device which obstructs access to the head of the closure bolt. Access to the bolt is provided through a hole in the overhang after removal of the locking device. The closure bolt is carried by the movable closure lid but must be inserted into the threaded nut and the threads engaged before the closure lid is drawn against the inside surface of a cubic receptacle formed under the overhanging portion. For instance, see U.S. Pat. No. 3,784,727 issued on 8 Jan. 1974 to Harold Dennis Haubein. It is readily apparent that the end of the bolt is subject to damage when inserted first through a hole in the cabinet wall and thereafter into the nut. A simpler, more cost effective closure device is dictated by the prior art, specifically a closure device that has the threads of the bolt always captured in the nut wherein a bearing surface of the parts of the enclosure are arranged behind the head of the bolt.

A locking mechanism for a transformer enclosure door is described in U.S. Pat. No. 6,106,035 issued on 22 Aug. 2000 to David L. Hetherington that has a spring biased bolt carried by one part of the enclosure and a wave spring nut carried in another part of the enclosure. The nose end of the bolt must still be inserted into the threaded wave spring in a ratcheting manner and then tightened in the manner described in Haubein above. The mechanism of Hetherington is expensive to manufacture and subject to damage when used repeatedly. Accordingly, there is still a need for a simpler, more cost effective closure device that has the threads of the bolt always captured in the nut wherein a bearing surface of the parts of the enclosure are arranged behind the head of the bolt to ensure repeated usage.

Finally, it is known to provide a conventional lock mechanism on one side of the housing which comprises a conventional type cooperating hasp and receptacle members. The members include a threaded socket for a "Penta-Bolt" and may include cooperating holes for receiving a padlock. The hasp member is rotatable and, upon closure of the removable portion of the housing to the bottom part, is inserted into a slot behind the threaded cylindrical socket. The bolt is then inserted into the threaded socket and driven into the a hole in the hasp member and a hole in the removable portion. For instance, see the U.S. Pat. No. 4,365,108 issued on 21 Dec. 1982 to William L. Bright. The bolt only projects into a hole in the hasp and into a hole in the cabinet so there is no threaded connection of the removable portion to the fixed portion of the cabinet. The bearing surface for the bolt is the bottom of the cylindrical socket provided only on the removable portion of the cabinet. Thus there is a need for a closure lock that carries the locking bolt in a threaded socket and has a portion of the bearing surface for the locking bolt in both enclosure members of the cabinet.

SUMMARY OF THE INVENTION

An object of this invention is to provide a thread retained security bolt system comprising a bottom collar fixed to one element of a enclosure and a top collar affixed to a mating element of the enclosure wherein the top collar carries a minor part of a securing bolt bearing surface and the bottom collar carries a major part of the securing bolt bearing surface, the minor part aligned with and contiguous to the major part upon joinder of the top collar with the bottom collar.

A primary goal of this invention is to provide a thread retained security bolt system comprising a bottom collar fixed to one element of a enclosure and a top collar affixed to a mating element of the enclosure wherein the top collar carries a minor part of a securing bolt bearing surface and the bottom collar carries a major part of the securing bolt bearing surface, the minor part aligned with and contiguous to the major part upon joinder of the top collar with the bottom collar wherein the minor part is aligned with and contiguous to the major part upon joinder of the top collar with the bottom collar.

A significant feature of this invention is to provide a thread retained security bolt system comprising a bottom collar fixed to one element of a enclosure and a top collar affixed to a mating element of the enclosure wherein the top collar carries a minor part of a securing bolt bearing surface and the bottom collar carries a major part of the securing bolt bearing surface wherein a bearing surface of a head of a bolt is moved into engagement with the minor part and the major part to secure the top collar to the bottom collar.

A main purpose of this invention is to provide a thread retained security bolt system which comprises a first part carrying a securing bolt and a second part movable in position for engagement by the securing bolt where the first part is a partial cylindrical sleeve extending outwardly from and affixed to a fixed portion of a cabinet and the second part is larger U-shaped sleeve affixed to a movable enclosure of the cabinet wherein the cylindrical sleeve is provided with a slot along at least a portion of a cylindrical wall thereof, the slot adapted to receive a bearing surface of the second part therethrough.

A primary principle of this invention is to provide a thread retained security bolt system which comprises a first part carrying a securing bolt and a second part movable in position for engagement by the securing bolt where the first part is a partial cylindrical sleeve extending outwardly from and affixed to a fixed portion of a cabinet and the second part is larger U-shaped sleeve affixed to a movable enclosure of the cabinet wherein the securing bolt bears against a bearing surface of the second part and a bearing surface of the first part thereby securing the movable portion of the cabinet against the fixed portion.

A principal aim of this invention is to provide a thread retained security bolt system comprising a bottom collar fixed to one element of a enclosure and a top collar affixed to a mating element of the enclosure wherein the top collar carries a minor part of a securing bolt bearing surface and the bottom collar carries a major part of the securing bolt bearing surface, the minor part aligned with and contiguous to the major part upon joinder of the top collar with the bottom collar wherein a bolt is carried by the bottom collar in a threaded receiver.

A primary aspect of this invention is to provide wherein a thread retained security bolt system comprising a bottom collar fixed to one element of a enclosure and a top collar affixed to a mating element of the enclosure wherein the top collar carries a minor part of a securing bolt bearing surface and the bottom collar carries a major part of the securing bolt bearing surface, the minor part aligned with and contiguous to the major part upon joinder of the top collar with the bottom collar wherein a bolt is carried by the bottom collar in a threaded receiver and the bottom collar has a padlock hole disposed through at least one wall thereof aligned with a padlock hole disposed through at least one wall of the top collar.

Another object of this invention is to provide a thread retained security bolt system wherein an interior plate of a double walled mounting structure has a threaded receiver disposed thereinto and wherein the securing bolt is threaded into the threaded receiver, the securing bolt retained by a retainer secured around a reduced portion of a shaft of the securing bolt, the retainer disposed between the internal plate and an external plate of the double walled mounting structure.

Another primary goal of this invention is to provide a thread retained security bolt system comprising a bottom collar fixed to one element of a enclosure and a top collar affixed to a mating element of the enclosure wherein the top collar is affixed to an inwardly turned flange of the mating element and wherein a minor part of a securing bolt bearing surface comprises a portion of a lip turned downwardly from the inwardly turned flange.

Another primary principle of this invention is to provide a thread retained security bolt system which comprises a bottom collar fixed to one element of a enclosure and a top collar affixed to a mating element of the enclosure wherein the bottom collar is affixed to an exterior surface of an exterior plate of a double walled mounting structure with a top side of the bottom collar assembly affixed to an inside surface of a sill of the one element, the bottom collar protruding through a hole in the sill.

Still other objects of this invention will become readily apparent from a careful study of the following description, appended claims and enclosed drawings.

DESCRIPTION OF THE PREFERRED EMBODIMENTS

While the various features of this invention are hereinafter described and illustrated as a thread retained security bolt system comprising a bottom collar fixed to one element of an enclosure and a top collar affixed to a mating element of the enclosure wherein the top collar carries a minor part of a securing bolt bearing surface and the bottom collar carries a major part of the securing bolt bearing surface, the minor part aligned with and contiguous to the major part upon joinder of the top collar with the bottom collar, it is to be understood that the various features of this invention can be used singly or in various combinations thereof a thread retained security bolt system as can hereinafter be appreciated from a reading of the following description.

Figure 1:
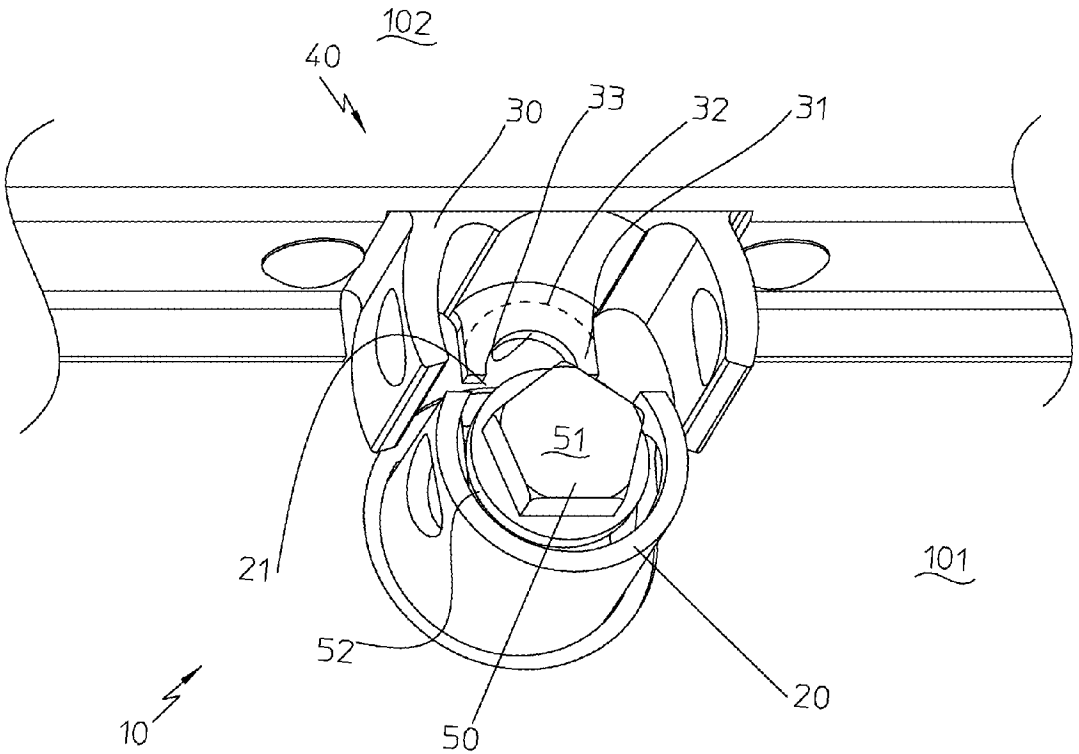
FIG. 1 is a perspective view of the preferred embodiment of the thread retained security bolt system of this invention showing passage of a portion of the bearing surface of the movable part behind the bearing plate of the security bolt.
Figure 5:
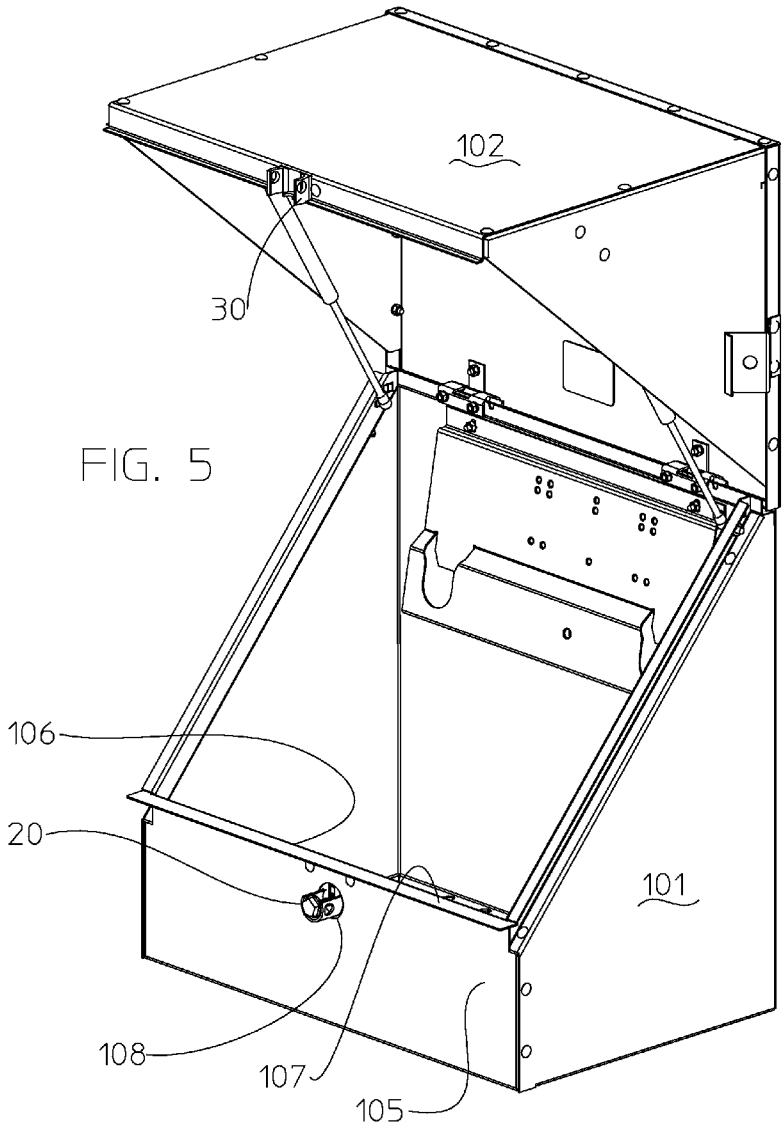
FIG. 5 is a perspective view of an electrical cabinet having the preferred embodiment of the thread retained security bolt system of FIG. 1 installed therein.

Referring now to FIG. 1, a thread retained security bolt system is generally shown by the number 10 and comprises a bottom collar 20 and a top collar 30. Bottom collar 20 is adapted to be fixed to one element 101, such as a base of an electrical cabinet enclosure as best shown in FIG. 5, and top collar 30 is adapted to be affixed to a mating element 102, such as the hood of the enclosure, also best shown in FIG. 5, top collar 30 carrying a minor part 31 of a securing bolt bearing surface 40 and bottom collar 20 carrying a major part 21 of securing bolt bearing surface 40, minor part 31 aligned with and contiguous to major part 21 upon joinder of top collar 30 on mating element 102 with bottom collar 20 on one element 101. In FIG. 1, joinder of top collar 30 and bottom collar 20 is not yet complete as minor part 31, shown beyond a dashed line 32, is not yet contiguous with major part 21, partially shown under a head 51 of a bolt 50. When minor part 31 is contiguous with major part 21, a bolt cusp 33 of minor part 31 is adjacent to a reduced diameter 53 of bolt 50, reduced diameter 53 shown best in FIG. 2, and securing bolt bearing surface 40 is completed. Upon joinder of bottom collar 20 of one element 101 to top collar 30 of mating element 102, a bearing surface 52 of head 51 of a bolt 50 is moved into engagement with securing bolt bearing surface 40, comprised of minor part 31 and major part 21, to secure top collar 30 to bottom collar 20 and hence secure mating element 102 to one element 101 thereby effecting closure of the enclosure. As will become readily apparent hereinafter, collars 20, 30 are preferably locked together with a pad lock through padlock holes 63, 39 respectively, wherein an arm of the padlock overlies bolt head 51 thereby preventing access thereto.

Figure 2:
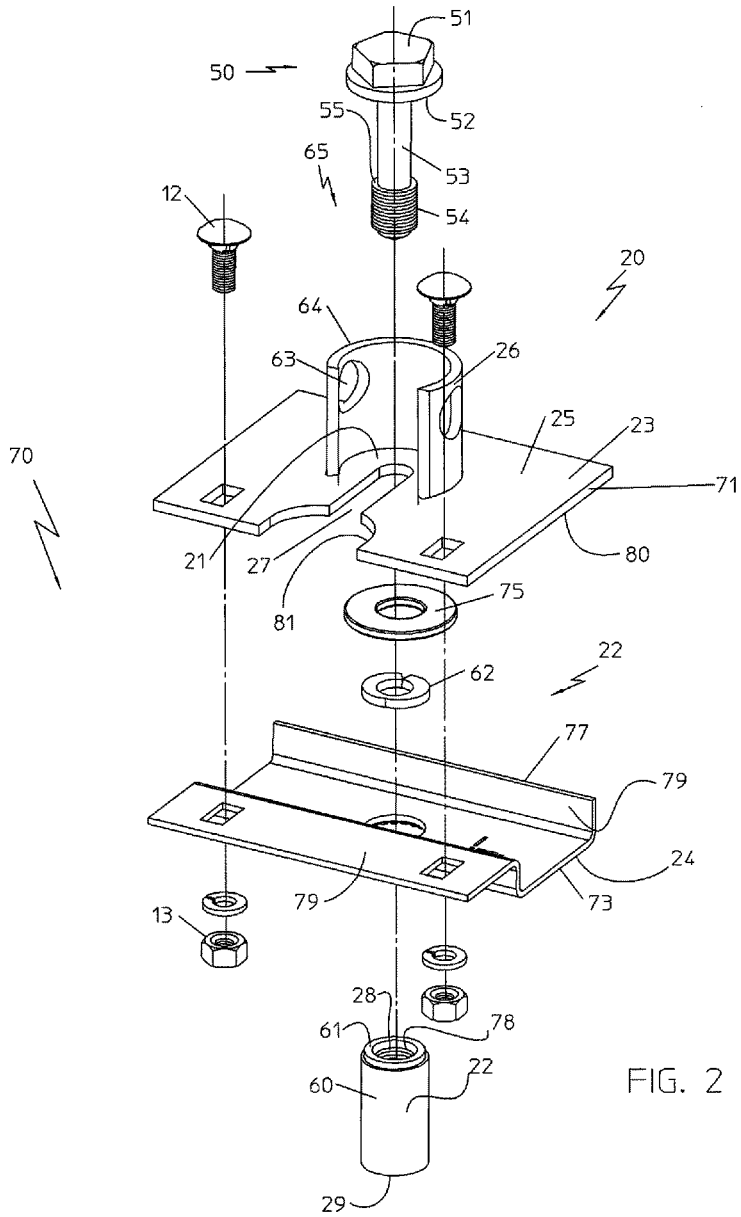
FIG. 2 is an exploded perspective view of the bottom collar of the thread retained security bolt system of FIG. 1.

Referring now also to FIG. 2, bolt 50 is carried by bottom collar 20 in a threaded receiver 22, threaded receiver 22 preferably attached to one side 24 of an interior plate 73 of a double walled mounting structure 70. Preferably, threaded receiver 22 is welded to interior plate 73, threaded receiver 22 aligned with a bolt slot 27 disposed through a mounting plate 23 of double walled structure 70, bolt slot 27 adapted to freely receive reduced diameter 53 of bolt 50 therethrough. Threaded receiver 22 is preferably an elongated cylinder 60 having threads 78 in a bore 28 disposed in a mounting end 61 thereof, threads 78 receiving threads 54 of bolt 50 therein. Threads 54 of bolt 50, once engaged with threads 78 in threaded receiver 22, are retained therein by a retainer 62 disposed between interior plate 73 and mounting plate 23 and thus threads 54 of bolt 50 are always engaged in threads 78 of threaded receiver 22. Retainer 62 is larger in diameter than the width of bolt slot 27 and hence bolt 50 is prevented from being removed from bottom collar 20 after assembly of threaded receiver 22 to mounting structure 70. Thus, for bottom collar 20 depicted in FIG. 2, assembly proceeds first with affixing threaded receiver 22 to interior plate 73, threading threads 54 of bolt 50 into threads 78 of threaded receiver 22, snap fitting retainer 62 around reduced diameter 53 of bolt 50 allowing retainer 62 to freely slide along reduced diameter 53, then installing mounting plate 23 over interior plate 73 by inserting reduced diameter 53 of bolt 50 into slot 27 of mounting plate 23. Interior plate 73 may be rigidly affixed to mounting plate 23 by welding an underside surface 80 thereof to a lip 77 and flange 79 of interior plate 73. Alternately, interior plate 73 may be loosely assembled to mounting plate 23 by passing carriage bolts 12 through aligned square holes provided through mounting plate 23 and a flange 79 of interior plate 73. As collar cylinder 26 and threaded receiver 22 are affixed to opposed sides 25, 24 of mounting structure 70, and bolt 50 is retained in threaded receiver 22 by retainer 62, bolt 50 cannot be removed from bottom collar 20 as retainer 62 abuts bottom surface 80 of mounting plate 23 when a shoulder 55 of threads 54 engages retainer 62. Though thread retained security bolt system 10 is generally designed for use in the electric power supply industry for securing a hinged hood 102 to a base portion 101 of a transformer cabinet or a dead front cabinet and hence preferably employs a "penta-bolt" for bolt 50, the description, claims and drawings are not so restrictive and the thread retained security bolt system 10 of this invention is applicable to a variety of closures. A "penta-bolt" has a pentagonal head and thus requires a special wrench in order to loosen bolt 50 to allow mating element 102 to swing free of element 101. Additionally, collar cylinder 26 surrounds head 51 of bolt 50 thus limiting access to bolt head 51 to a socket wrench matching head 51 of bolt 50. Additionally, though collar cylinder 26 is depicted in the figures as round, it is fully within the scope of this invention for collar cylinder 26 to be polygonal comprising a plurality of planar walls joined together into collar cylinder 26.

In order to provide additional security for thread retained security bolt system 10, collar cylinder 26 of bottom collar 20 has at least one padlock hole 63 disposed through at least one wall 64 thereof, padlock hole 63 adapted to receive a shackle of a padlock therethrough wherein at least a portion of the shackle overlies head 51 of bolt 50 such that a socket wrench cannot be properly placed over head 51 of bolt 50. Furthermore, top collar 30 preferably has a padlock hole 39 disposed through at least one collar wall 38 thereof wherein a shackle of a padlock may also be passed through hole 39 and through hole 63 thus further securing mating element 102 to element 101 as will become readily apparent hereinafter. It should also be readily apparent that collar cylinder 26 and collar walls 38 of top collar 30, hereinafter described, prevent access to bolt head 51 of bolt 50 as wall 64 of collar cylinder 26 and walls 38 of top collar 30 fully surround head 51 of bolt 50 when top collar 30 and bottom collar 20 are joined.

Figure 3:
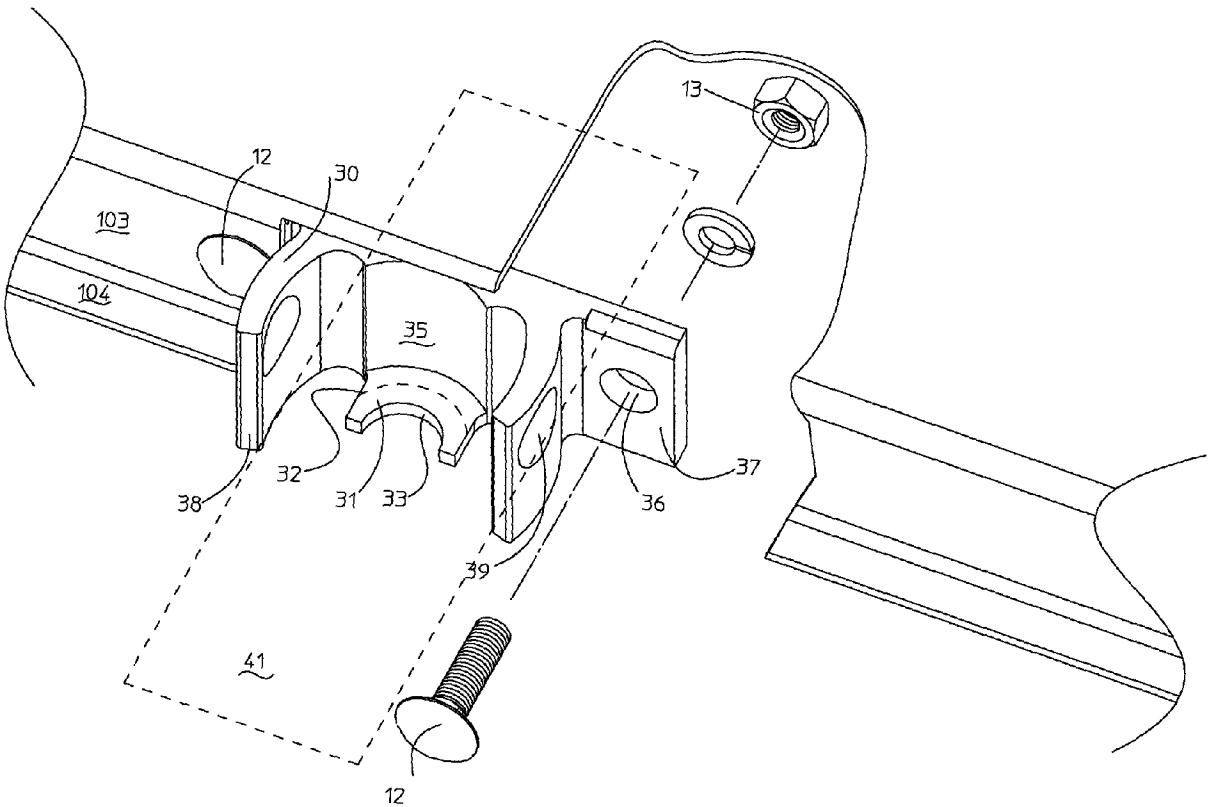
FIG. 3 is a perspective view of the top collar of the thread retained security bolt system of FIG. 1.

Top collar 30 is best shown in FIG. 3 wherein top collar 30 is affixed to an inwardly turned flange 103 of mating element 102 and wherein minor part 31 effectively completes a portion of a lip 104 turned downwardly from inwardly turned flange 103. An upper inside surface 35 of top collar 30 also effectively completes collar cylinder 26 upon joinder of top collar 30 to bottom collar 20 and collar walls 38 of top collar 30 overlie a portion of collar wall 64 of bottom collar 20. Though upper inside surface 35 is depicted as circular, it is fully understood that upper inside surface 35 could be at least one planar surface thus completing a polygonal collar cylinder 26. Top collar 30 is affixed to inwardly turned flange 103 with carriage bolts 12 disposed through inwardly turned flange 103 and an attaching hole 36 through a base 37 of top collar 30 with nuts 13 threaded thereonto, though of course, rivets or other suitable fasteners may be used to affix top collar 30 to inwardly turned flange 103 without departing from the scope of this invention. Carriage bolts are preferred for bolts 12 for ease of mounting but also for the security provided by the smooth round head of the carriage bolt, thus inhibiting removal of either top collar 30 or bottom collar 10 from the cabinet. Base 37 is shown in a broken away section of inwardly turned flange 103 in FIG. 3 it being fully understood that base 37 abuts an inside surface of inwardly turned flange 103 for securement thereto. Extending outwardly from base 37 and perpendicular thereto is at least one collar wall 38, collar wall 38 adapted to overlie collar cylinder 26 of bottom collar 20, collar wall 38 having a padlock hole 39 disposed therethrough. Typically, base 37 has two collar walls 38 such that each collar wall 38 overlies collar cylinder 26 on both sides thereof such that access to an interior of collar cylinder 26 is denied except through an exposed end 65 thereof. As has already been recited, exposed end 65 is additionally denied access when a padlock shackle is passed through hole 39 in at least one collar wall 38 and through at least one padlock hole 63 in collar cylinder 26 wherein the shackle of the padlock lies over at least a portion of head 51 of bolt 50. It is also within the scope of this invention to pass the shackle of the padlock through one hole 39 in one collar wall 38, through one aligned padlock hole 63 in collar cylinder 26, across head 51 of bolt 50, through an opposed padlock hole 63 in collar cylinder 26 and finally through an aligned hole 39 in an opposed collar wall 38 of top collar 30.

Though top collar 30 is described and shown as comprising a portion of an inwardly turned flange 103 and a downwardly turned lip 104 of inwardly turned flange 103 of a mating element 102 of an electrical enclosure, it is fully understood that top collar 30 may be affixed to an edge of, or incorporated into, a cabinet door while bottom collar 20 is affixed to, or incorporated into an inside wall of a cabinet without departing from the scope of this invention. Furthermore, it is also within the scope of this invention to reverse the location of collars 20, 30 such that top collar 30 is affixed to a fixed element 101 of a cabinet while bottom collar 20 is affixed to a mating movable element of the cabinet 102. In an electrical enclosure, such as shown in FIG. 5, it is preferred that bottom collar 20 is affixed to an exterior surface 72 of an exterior plate 71 of double walled mounting structure 70 wherein top side 25 of mounting plate 23 is affixed to an inside surface 106 of a sill 105 of element 101 and wherein collar cylinder 26 of bottom collar 20 protrudes through a hole 108 in sill 105. Bottom collar 20 is affixed to sill 105 with carriage bolts for bolts 12 wherein bolts 12 are proximate an outwardly turned lip 107 of sill 105, thus greatly limiting access to bolts 12. As nuts 13 on bolts 12 retaining top collar 30 and bottom collar 20 to the cabinet are disposed interior of the cabinet, access thereto is limited to personnel with keys for the padlock and a penta-bolt socket wrench.

Figure 4:
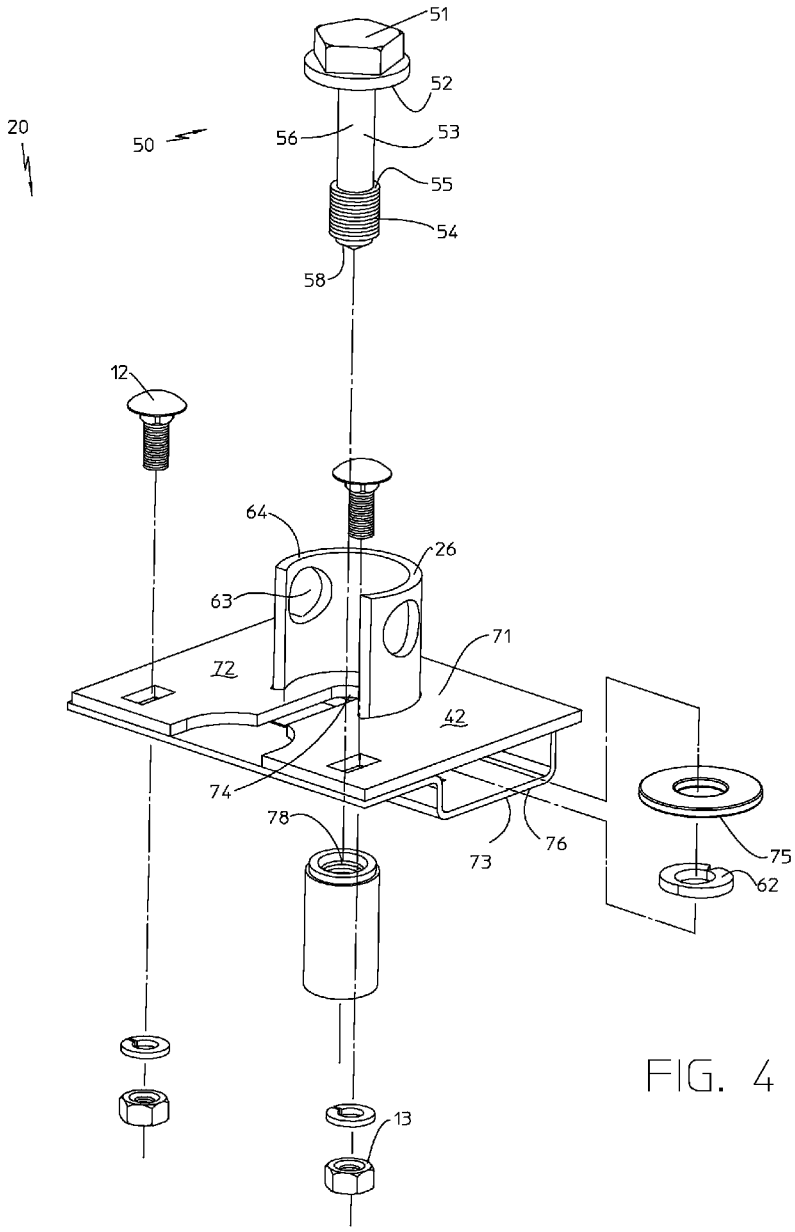
FIG. 4 is an exploded perspective view of an alternate bottom collar of the thread retained security bolt system of FIG. 1.

In an alternate embodiment shown in FIG. 4, while also referring to FIG. 3, thread retained security bolt system 10 comprises a bottom collar 20 and an overlapping top collar 30 wherein bottom collar 20 further comprising a partial cylindrical sleeve 26 affixed to an exterior surface 72 of mounting plate 71 with exterior surface 72 of integral mounting plate 71 of bottom collar 20 affixed to an inside surface 106 of a sill 105 of one element 101 of an enclosure. Overlapping top collar 30 is affixed to a mating element 102 of the enclosure, overlapping top collar 30 carrying a minor part 31 of a securing bolt bearing surface 40, minor part 31 disposed in a plane 41 perpendicular to base 37 of overlapping top collar 30, plane 41 shown in dashed lines in FIG. 3. Bottom collar 20 carries major part 21 of bearing surface 40 in a plane 42 perpendicular to partial cylindrical sleeve 26 of bottom collar 20, plane 42 coincident with exterior mounting surface 72. Mating element 102 is moveable to align plane 41 of securing bolt bearing surface 40 of minor part 31 with plane 42 of securing bolt bearing surface 40 of major part 21 whereupon securing bolt 50 carried by bottom collar 20 is moved into engagement with securing bolt bearing surface 40 of minor part 31 and securing bolt bearing surface 40 of major part 21 to secure mating element 102 to element 101. Since partial cylindrical sleeve 26 is affixed directly to exterior mounting surface 72, an interior plate 73 of double walled mounting structure 70 has threaded receiver 22 associated therewith and specifically has threaded receiver 22 disposed thereinto though an extension of threaded receiver 22 may extend from interior plate 73 without departing from the scope of this invention. Exterior plate 71 has a thread passage hole 74 disposed therethrough, thread passage hole 74 concentric with partial cylindrical sleeve 26 and aligned with threaded receiver 22. Securing bolt 50 is threaded into threaded receiver 22 by passing threads 54 through thread passage hole 74 in exterior plate 71 and threading same into threads 78 disposed into threaded receiver 22 whereupon securing bolt 50 is retained in double walled mounting structure 70 of bottom collar 20 by retainer 62 secured around reduced portion 53 of shaft 56 of securing bolt 50. Retainer 62 larger in outside diameter than thread passage hole 74 and thus when securing bolt 50 is rotated in threads 78 of thread receiver 22, retainer 62 is captured between shoulder 55 of threads 54 and an underside 80 of exterior plate 71 thus preventing securing bolt 50 from being lost when mating element 102 is hinged away from element 101. Retainer 62 is inserted between exterior plate 71 and interior plate 73 and snap fitted around reduced diameter 53 of shaft 56 and thus retainer 62 is disposed between internal plate 73 and external plate 71, severely limiting access to retainer 62. Retainer 62 may be circle clip, an E-clip or a malleable washer though other retainers may be used to advantage without departing from the scope of this invention.

In another embodiment, thread retained security bolt system 10 may have retainer 62 disposed in a slot groove 57 adjacent an end 58 of threads 54 of bolt 50 wherein retainer 62 is adjacent an end surface 29 of a shortened threaded receiver 22, shortened threaded receiver 22 affixed to backside surface 80 of mounting plate 23. As with the preferred embodiment of thread retained security bolt system 10, partial cylindrical sleeve 26 of bottom collar 20 has at least one padlock hole 63 disposed through at least one wall 64 thereof, it being fully understood that wall 64 may be polygonal instead of circular as depicted. As top collar 30 is substantially the same as described for the preferred embodiment, it is understood that top collar 30 also has padlock hole 39 disposed through at least one wall 38 wherein at least one padlock hole 63 in wall 64 of partial cylindrical sleeve 26 of bottom collar 20 is aligned with at least one padlock hole 39 in wall 38 of top collar 30.

Top collar 30 may be die cast or machined from bar stock but is preferably extruded in the general shape shown in FIG. 3 and has machine work performed thereupon to complete surfaces 35 and 31 while completing walls 38. Bottom collar 20 of FIG. 2 is preferably assembled from distinct parts, partial cylinder 26, mounting plate 23, interior plate 73, bolt 50 and threaded receiver 22. Threaded receiver 22 is preferably an elongated steel cylinder 60 as depicted in FIG. 2 to allow for sufficient thread length for threads 78 to permit bolt 50 to travel enough to permit minor part 31 of top collar 30 to freely pass by bolt head 51 when opening or closing the cabinet. Interior plate 73 is preferably bent from flat steel plate approximately one-eighth inch thick wherein flange 79 is formed on one edge thereof and lip 77 is formed opposite flange 79. The depth of lip 77 and flange 79 determine the length of travel of bolt 50 as retainer 62 stops loosening of bolt 50 when retainer 62 abuts inside surface 80 of mounting plate 23 and shoulder 55 of bolt 50. Since bolt 50 is retained in threaded receiver 22 by retainer 62, loss of bolt 50 is not possible and closure of the cabinet is greatly enhanced because bolt 50 does not need to be aligned with a nut. Partial cylinder 26 is preferably extruded with padlock holes 63 disposed thereinto in a machining operation. Of course, partial cylinder 26 may be fully formed by die casting. Exterior plate 23 is cut from flat stock and has slot 27, an enlarged entry cusp 81 and the square mounting holes cut thereinto. Partial cylinder 26 is welded to exterior plate 23 and threaded receiver 22 is preferably welded to interior plate 73. Bolt 50 is a standard penta-bolt but has reduced diameter 53 formed thereupon by removal of threads 54 in the area of reduced diameter 53. Mounting bolts 12 and nuts 13 are purchased as stock steel carriage bolts and nuts. At assembly of bottom collar 20 of FIG. 2, upon attaching partial cylinder 26 to mounting plate 23 and threaded receiver 22 to interior plate 73, bolt 50 has a washer 75 first disposed onto reduced portion 53 and thereafter retainer 62 fitted around reduced portion 53 adjacent shoulder 55. Assembled bolt 50 has head 51 placed into partial cylinder 26 at an angle while aligning reduced portion 53 with slot 27. Cusp 81 is provided at the end of slot 27 to permit passage of washer 75 and retainer 62 therethrough as bolt 50 is rotated into alignment with partial cylinder 26. As head 51 of bolt 50 will not pass through the open face of partial cylinder 26, bolt 50 is retained therein thus facilitating assembly of interior plate 73 to mounting plate 23.

Construction of bottom collar 20 of FIG. 4 is similar to the construction of bottom collar 20 of FIG. 2, except that exterior plate 71 and interior plate 73 are affixed together at flange 79 and lip 77. Exterior plate 71 and interior plate 73 may also be formed from a single piece of flat stock by bending flange 79, bending lip 77 and thereafter bending exterior plate 71 at lip 77 to lie flat upon flange 79. Upon completion of exterior plate 71 and interior plate 73, threaded receiver 22 is affixed to bottom surface 76 of interior plate 73 and partial cylinder 26 is concentrically aligned therewith and welded to exterior surface 72 of exterior plate 71. Bolt 50 is then passed through hole 74 in exterior plate 71, preferably through a washer 75 and threaded into threaded receiver 22. When reduced portion 53 is visible between interior plate 73 and exterior plate 71, retainer 62 is fitted around reduced portion 53 of bolt 50 between washer 75 and shoulder 55 thus retaining bolt 50 in threaded receiver 22.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A thread retained security bolt system comprises a bottom collar, a top collar and a securing bolt, said bottom collar fixed to one element of an enclosure and said top collar affixed to a mating element of said enclosure, said top collar carrying a minor part of a securing bolt bearing surface and said bottom collar carrying a major part of said securing bolt bearing surface, said minor part aligned with and contiguous to said major part upon joinder of said top collar with said bottom collar whereupon said minor part and said major part constitute a combined securing bolt bearing surface and whereupon a bearing surface of a head of said securing bolt is moved into engagement with said combined surface of said minor part and said major part to secure said top collar of said mating element of said enclosure to said bottom collar of said one element of said enclosure.

2. A thread retained security bolt system as in claim 1 wherein said bolt is carried by said bottom collar in a threaded receiver.

3. A thread retained security bolt system as in claim 1 wherein said bottom collar has a padlock hole disposed through at least one wall thereof.

4. A thread retained security bolt system as in claim 1 wherein said top collar has a padlock hole disposed through at least one wall thereof.

5. A thread retained security bolt system comprises a bottom collar and a top collar, said bottom collar fixed to one element of an enclosure and said top collar affixed to a mating element of said enclosure, said top collar carrying a minor part of a securing bolt bearing surface and said bottom collar carrying a major part of said securing bolt bearing surface, said minor part aligned with and contiguous to said major part upon joinder of said top collar with said bottom collar and whereupon a bearing surface of a head of a securing bolt is moved into engagement with said minor part and said major part to secure said top collar to said bottom collar wherein said top collar is affixed to an inwardly turned flange of said mating element wherein said minor part comprises a portion of a lip turned downwardly from said inwardly turned flange.

6. A thread retained security bolt system as in claim 5 wherein said bottom collar is affixed to an exterior surface of an exterior plate of a double walled mounting structure and wherein said exterior surface of said bottom collar is affixed to an inside surface of a sill of said one element.

7. A thread retained security bolt system as in claim 5 wherein said bottom collar protrudes through a hole in said sill.

8. A thread retained security bolt system comprises a bottom collar and a top collar, said bottom collar fixed to one element of an enclosure and said top collar affixed to a mating element of said enclosure, said top collar carrying a minor part of a securing bolt bearing surface and said bottom collar carrying a major part of said securing bolt bearing surface, said minor part aligned with and contiguous to said major part upon joinder of said top collar with said bottom collar and whereupon a bearing surface of a head of a securing bolt is moved into engagement with said minor part and said major part to secure said top collar to said bottom collar, said securing bolt carried by said bottom collar in a threaded receiver wherein an interior plate of a double walled mounting structure of said enclosure has said threaded receiver associated therewith.

9. A thread retained security bolt system as in claim 8 wherein said interior plate of said double walled mounting structure has said threaded receiver disposed thereinto.

10. A thread retained security bolt system as in claim 9 wherein said securing bolt is threaded into said threaded receiver.

11. A thread retained security bolt system as in claim 10 wherein said securing bolt is retained in said bottom collar by a retainer secured around a reduced portion of a shaft of said securing bolt.

12. A thread retained security bolt system as in claim 11 wherein said retainer is disposed between said interior plate and an exterior plate of said double walled structure.

13. A thread retained security bolt system comprises a bottom collar and an overlapping top collar, said bottom collar further comprising a partial cylindrical sleeve affixed to a mounting plate, said bottom collar affixed to one element of an enclosure and said overlapping top collar affixed to a mating element of said enclosure, said overlapping top collar carrying a minor part of a securing bolt bearing surface disposed in a plane perpendicular to said overlapping top collar, said bottom collar carrying a major part of said bearing surface in a plane perpendicular to said partial cylindrical sleeve of said bottom collar, said mating element moveable to align said plane of said securing bolt bearing surface of said minor part with said plane of said securing bolt bearing surface of said major part whereupon a securing bolt carried by said bottom collar is moved into engagement with said securing bolt bearing surface of said minor part and said securing bolt bearing surface of said major part to secure said mating element to said one element.

14. A thread retained security bolt system as in claim 13 wherein said bolt is threadedly engaged with and retained in a threaded receiver.

15. A thread retained security bolt system as in claim 14 wherein said securing bolt is retained in said bottom collar by a retainer secured around a reduced portion of a shaft of said securing bolt.

16. A thread retained security bolt system as in claim 15 wherein said retainer is disposed in a slot groove adjacent an end of said bolt and thus is disposed adjacent a back side surface of said threaded receiver.

17. A thread retained security bolt system as in claim 16 wherein said partial cylindrical sleeve of said bottom collar has a padlock hole disposed through at least one wall thereof.

18. A thread retained security bolt system as in claim 17 wherein said top collar has a padlock hole disposed through at least one wall thereof.

19. A thread retained security bolt system as in claim 18 wherein said padlock hole in said wall of said cylindrical sleeve of said bottom collar is aligned with said padlock hole in said wall of said top collar.

20. A thread retained security bolt system comprises a first part carrying a securing bolt and a second part movable in position for engagement by said securing bolt, said first part affixed to a fixed portion of a cabinet and said second part affixed to a movable hood of said cabinet, said first part further comprising a cylindrical sleeve extending outwardly from a wall of said fixed portion of said cabinet, said cylindrical sleeve provided with a slot along at least a portion of a cylindrical wall thereof, said slot adapted to receive a bearing surface of said second part therethrough, said securing bolt bearing against said bearing surface of said second part and a bearing surface of said first part thereby securing said movable portion of said cabinet against said fixed portion.

* * * * *